United States Patent [19]

Ross

[11] Patent Number: 4,552,189

[45] Date of Patent: Nov. 12, 1985

[54] MACHINE AND METHOD FOR CLEANING CAN FLANGES

[75] Inventor: Edward E. Ross, San Rafael, Calif.

[73] Assignee: Del Monte Corporation, San Francisco, Calif.

[21] Appl. No.: 427,675

[22] Filed: Sep. 29, 1982

[51] Int. Cl.[4] ..... B65B 63/00; B30B 1/26

[52] U.S. Cl. ..... 141/80; 53/515; 53/527; 100/39; 100/98 R; 100/153; 100/178; 100/291; 100/295

[58] Field of Search ..... 141/80; 83/326; 53/513, 53/515, 527; 100/98 R, 39, 291, 177, 178, 153, 208, 209, 295

[56] References Cited

U.S. PATENT DOCUMENTS

| | | | |
|---|---|---|---|
| 2,300,704 | 11/1942 | Russell | 141/80 |
| 2,350,438 | 6/1944 | Woerz | 141/80 |
| 2,444,502 | 7/1948 | Fromer | 141/80 |
| 2,492,826 | 12/1949 | Ardron | 141/80 |
| 4,000,598 | 1/1977 | Mierke | 53/515 |

*Primary Examiner*—Billy J. Wilhite

*Attorney, Agent, or Firm*—Flehr, Hohbach, Test, Albritton & Herbert

[57] ABSTRACT

A machine for cleaning the flanges of cans. After fruit has been deposited in cans being carried by a conveyor, pistons that are slidably carried by a second conveyor are caused to enter each can. Each piston is so constructed that it severs fruit material on the can flange and compresses the fruit therein.

10 Claims, 10 Drawing Figures

MACHINE AND METHOD FOR CLEANING CAN FLANGES

This invention relates generally to machines and methods for cleaning the flanges of cans after food has be deposited therein and before the cans have been sealed by seaming.

In the food canning industry it is conventional practice to deposit a measured quantity of food material into the can after which the can is sealed in a sealing machine and retorted for sterilization of the contents. Some food materials, particularly whole or cut green beans, are of such a character that when introduced into the can either manually or by machine, such as a Solbern tumbler filler, some of the beans hang over the upper edge or flange of the can in a random fashion. Such beans must be removed from the flange as otherwise they interfere with proper can seaming, causing such difficulties as knock-down flanges and false seams, with resulting damage to the cans. Improperly seamed cans are usually the cause of spoilage of the contents with bursting of the can, and spillage of the contents on other cans and on cases in storage. This has been a serious problem in the canned bean industry, and it has been calculated that losses from damaged goods may approximate $1,000,000 per year, in addition to the cans that are rejected during seaming.

The machines and methods that have been proposed in the past for alleviating this difficulty, have not been effective. One machine for this purpose makes use of a belt that was pressed down on top of the cans in an effort to sever and remove food material from the upper edges. This has been found to be ineffective since beans are fibrous and stringing, and cannot be easily severed in this fashion. Pistons of various types have likewise been tried and have proved to be unsuccessful. They have not been constructed in such a fashion as to effectively sever and remove beans when the piston is introduced into the flange end of the can. Also occasional misalignment of the can with respect to the plunger may result in flange injury.

In general it is an object of the present invention to provide a machine and method for cleaning can flanges, which overcomes the difficulties experienced with the previous machines that have been proposed for this purpose.

Another object of the invention is to provide a machine and method which effectively severs beans which may be deposited upon the upper edge of the can, and in addition makes possible further removal of beans or bean fragments from the flange portion, and compaction of the contents.

Another object is to provide a machine and method which makes use of pistons which when projected into the can serve several functions, including further removal of beans and bean fragments from the flanges, compaction of the contents, and alignment of the piston relative to the can.

Another object is to provide a machine and method which functions in an automated fashion to carry out effective cleaning of the can flanges preparatory to a seaming operation.

In general the present invention is a machine and method for cleaning the flanges of food containing cans preparatory to can seaming and after a quantity of food material like whole or french sliced green beans have been introduced into the cans. Means are provided which press a rigid flat surface upon the upper edges of the cans, to effectively sever any food deposited thereon. A piston member is provided which has a cylindrical surface that closely fits the flange portion of the can, and which has a lower face that is adapted to engage and compress the contents of the can. The piston also has means extending from its lower face which serves to guide the piston and align it with the axis of the can at the time it is introduced. In its preferred form, the machine makes use of means for conveying a row of cans along a pathway, with the centers of the cans spaced apart a predetermined distance. An endless conveyor has its lower run extending over the row of cans, and is provided with rigid flights having their centers spaced apart in accordance with the spacing between the cans. As the cans proceed along a pathway underlying the lower run of the endless conveyor, means serves to urge the flights against the upper edges of the cans to cause severance of items of food thereon. Each flight also carries a piston which has a cylindrical surface dimentioned to have a close fit within the flange of the can. The lower face of each piston is adapted to engage and compact the contents of the can. Guide means is carried by the lower end of each piston to guide the same into the can. Each piston also has an annular cutting edge at the junction between the lower face of the piston, and its cylindrical surface. Means is provided for projecting each piston into its associated can, whereby fiber remaining on the upper edge of the can is severed and food is removed from the inner surface of the flange by the sweeping and cutting action of the piston, after which the piston is retracted.

Additional features and objects of the invention will appear from the following description in which the preferred embodiment has been disclosed in detail in conjunction with the accompanying drawing.

Referring to the drawing.

FIGS. 5A to 5F schematically shows several stages in the operation of the machine.

Figure 1:
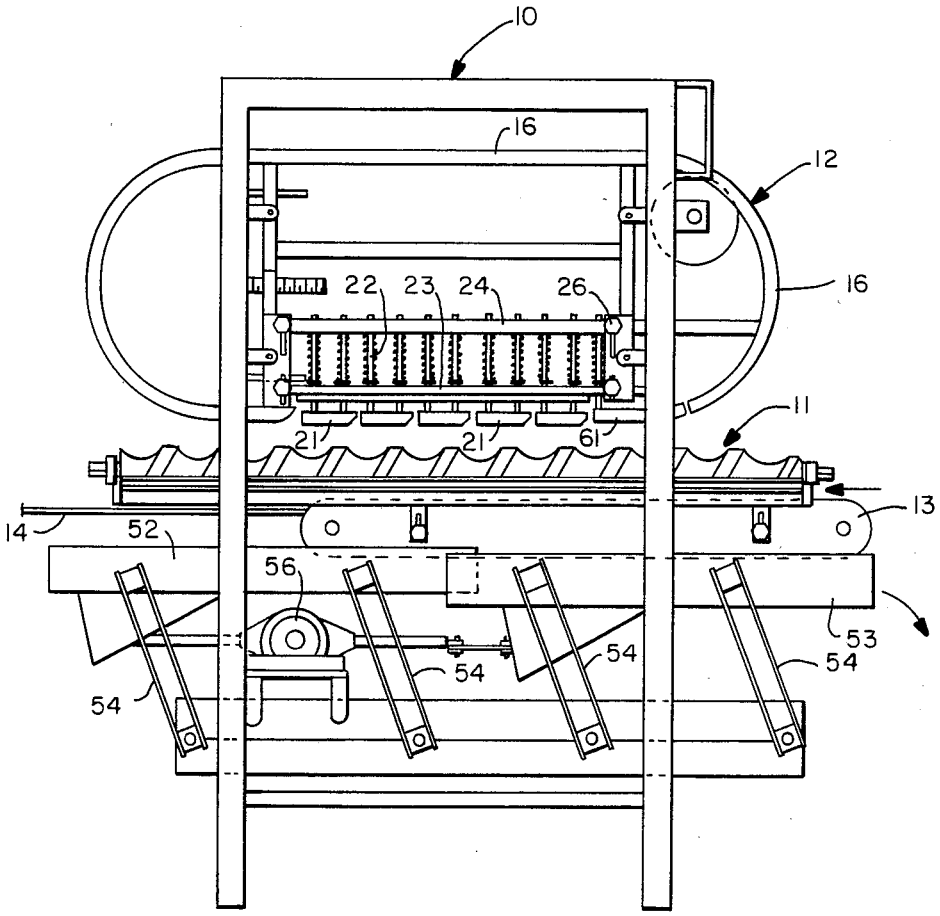
FIG. 1 is a side elevational view of a machine incorporating the present invention.
Figure 2:
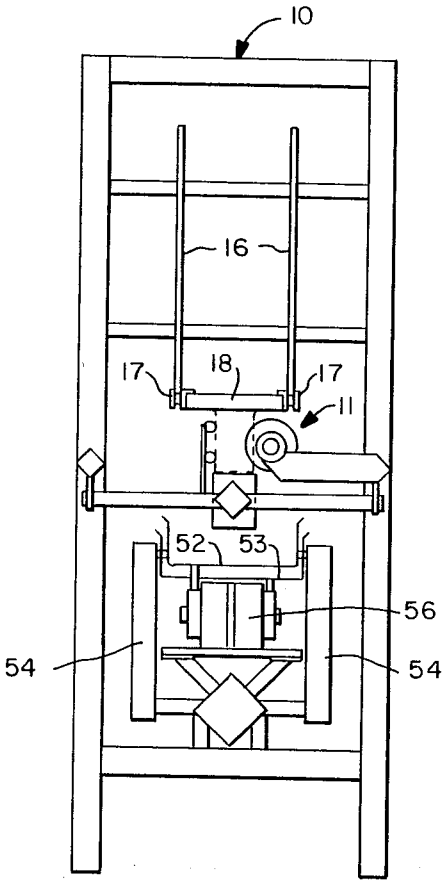
FIG. 2 is an end view of the machine as shown in FIG. 1.

Referring to FIG. 1 the machine consists of a frame 10 which serves to mount the various working parts of the machine. Conveying means 11 carried by the frame serves to convey a row of cans along a linear horizontal pathway. A second conveying means 12 shown particularly in FIG. 4, carries means which act upon the cans being moved along the pathway, to carry out the operations of crushing and severing items of food which may be deposited upon the upper edges of the cans, severing and removing any items of food which remain upon the inner periphery of the flanges, and to compact the food within the can preparatory to a seaming operation.

Figure 3:
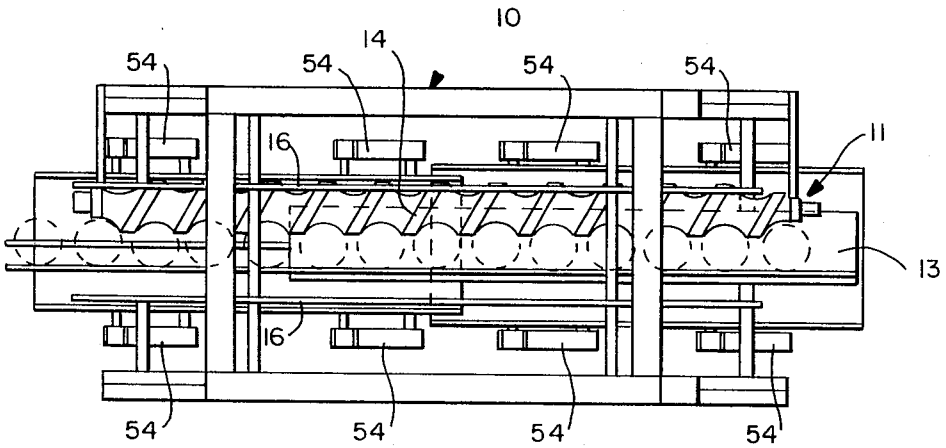
FIG. 3 is a plan view of the machine.

As shown in FIG. 3 the first conveying means 11 may be of conventional construction, consisting of an endless conveyor chain 13 of the plate top type which serves to support the cans and a feed screw 14 which engages the sides of the can and serves to maintain even spacing between the can centers. The upper run of the conveyor 13 is supported by an underlying stationary plate. As cans are discharged from the end of the endless conveyor 13 they drop down upon the support 14, from which they are discharged.

Figure 4:
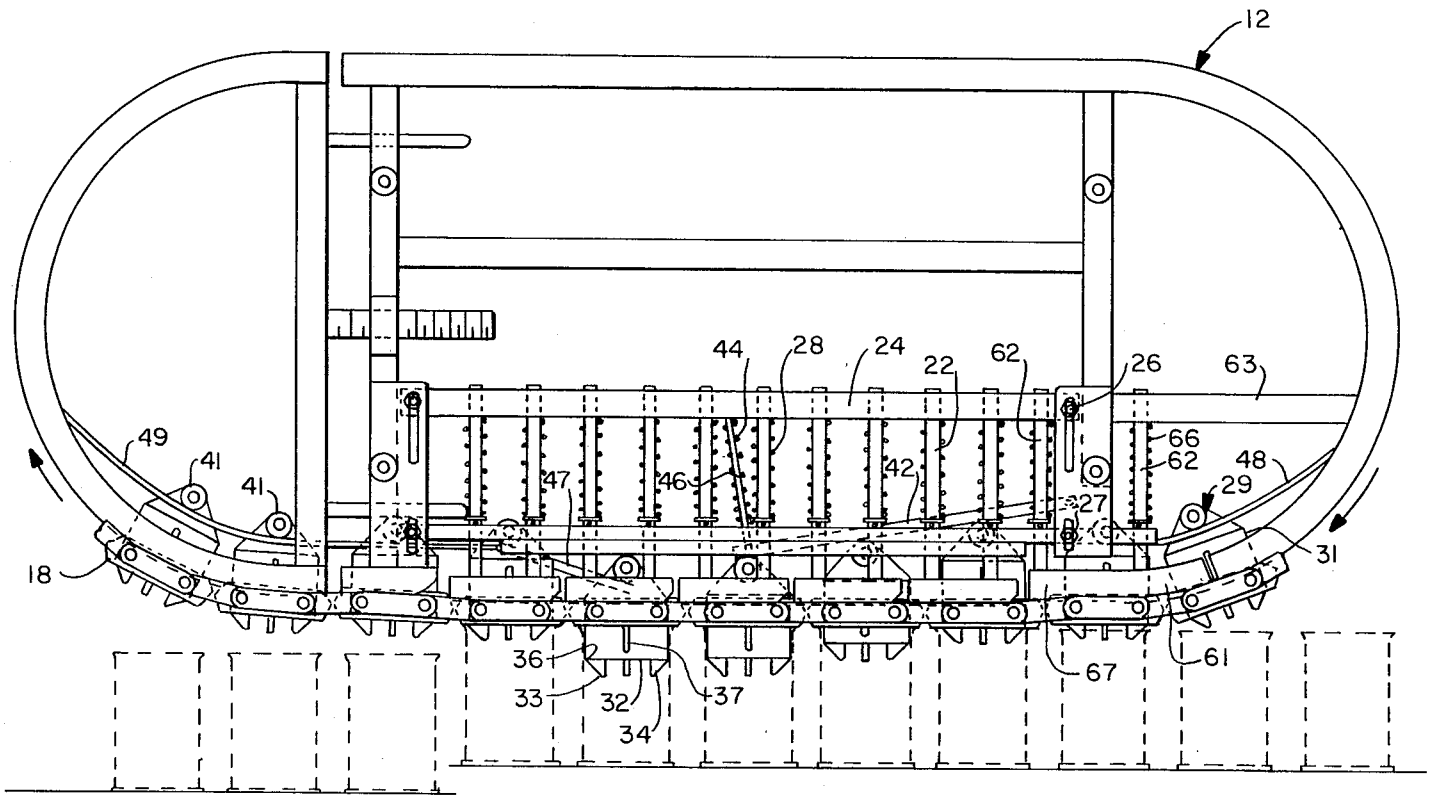
FIG. 4 is a side elevational view of the working parts of the machine, drawn to an enlarged scale.

The second conveyor 12 consists of guidetracks 16 which may have the configuration shown in FIG. 1. The guidetracks are engaged by roller chains 17, and the chains are secured to and carry the rigid flights 18. (FIG. 4) Each flight has its ends secured to one of the links of the roller chain, and it may be in the form of a flat plate made of suitable material such as molded or machined plastic. The distance between centers of the flights corresponds to the distance between the centers between the cans, as they are carried along by the guideway formed by the first conveyor means. There is a central opening through each of the flights which accommodates a piston to be presently described. As shown in FIGS. 1 and 4 the guidetracks are interrupted in a region above the cans on the first conveyor means.

Means are provided for pressing the lower flat faces of the flights downwardly against the upper edges of the cans, as the cans are being advanced along the pathway of the conveyor 11. Thus a series of presser members 21 in the form of shoes are secured to the lower ends of the rods 22. The stationary bars 23 and 24 have openings which slidably accommodate the rods 22. The bar 24 is fixed to the frame as by means of bolts 26 which permit some vertical adjustment, and the lower bar 23 is likewise fixed to the frame as by means of bolts 27. The shoes are in pairs with a shoe of each pair being positioned to ride upon the corresponding chain 17. Compression springs 28 press the rods 22 downwardly, whereby the shoes press down upon underlying links of the chains, thereby pressing the flat lower face of each of the flights against the associated can edge.

As previously mentioned, a piston 29 is carried by each of the flights. Each piston can likewise be made of a suitable plastic material. Its configuration (FIG. 4) is such that it has a cylindrical surface 31, and a flat end face 32. Its lower face is provided with a plurality of circumferentially spaced lugs 33, which have inclined edges 34, that are coincident with a truncated cone having an axis coincident with the axis of the cylindrical surface 31. These lugs serve as guide means for aligning the axis of the piston with the axis of the can, before the piston is advanced into the can. The junction between the cylindrical surface and the flat face 32, forms the cutting edge 36. Rotation of the piston about its axis is prevented by a groove 37 on one side of the piston, which is engaged by suitable means such as a pin fixed to the associated flight. This also limits axial movement of the pistons.

The upper end of each piston carries a pair of rollers 41 which are on an axis at right angles to the axis of the piston, and transverse to the general plane of the track 16. As a piston together with its associated conveyor flight passes into the pathway of the cans, the rollers engage the inclined cam bar 42, whereby the piston is caused to be advanced into the can. There are two cam bars 42, one for each of the piston rollers, and each cam bar has one end of the same pivotally attached to a frame at 43, and the other end urged downwardly by the compression spring 44. A retaining rod 46 extends through a compression spring 44 and has its lower end attached to the bar 42, and its upper end slidably retained by the bar 24. Another pair of cam bars 47, that are fixed to the machine frame, are engaged by the rollers 41 of each piston whereby the pistons are retracted from the cans.

Guide strips 48 also engage the rollers 41 for a portion of the travel of the pistons as they approach the conveyor means 11, and guide strips 49 engage the rollers as the pistons leave the conveyor means 11.

During normal operation of the machine with the cans being filled with a food material like green beans, fragments of the beans fall off from the cans as they progress through the machine. These food fragments are collected by the underlying pans 51 and 52. The pans are carried by links 53 and 54 which are pivotally carried by the machine frame, and both pans are connected to the eccentric shaking means 56. Thus the shaking movement imparted to the pans causes the collected food fragments to be conveyed and discharged from the right hand end of pan 51, as used in FIG. 1.

In a region near the entrant end of the machine the trackway 16 is interrupted to provide the short track pieces 61. Each of these pieces is attached to the lower ends of the rods 62, which in turn are carried by the bar 24 and one member 63 of the machine frame. Springs 66 surround the rods 62 and serve to yieldably urge the piece 61 against the chain of the second conveyor. As shown in FIG. 4 as a flight and its associated piston approaches a can and progresses below the pieces 61, the piston is generally aligned with the can before it is projected downwardly by contact with the cam bars 42. Thus the aligning lugs 33 of the piston are advanced to a position slightly within the upper part of the can, before a flight moves further to cause the piston to be projected downwardly into the can. It is particularly in this latter condition that the guide lugs ensure alignment between the axis of the piston and the axis of the can, before the cutting edge and the cylindrical surface of the piston are projected into the upper end of the can. It will be noted that the guidetrack pieces 61 have downwardly offset portions 67, which serve to lower links of the chain passing underneath these portions, thereby lowering the flight for further movement below the first one of the shoes 21. Guidetrack pieces 61 also yield in the event the lugs 30 should engage the bottom of an upside down can, thus avoiding breakage of the can or piston.

Figures 5A, 5B, 5C, 5D, 5E, 5F:
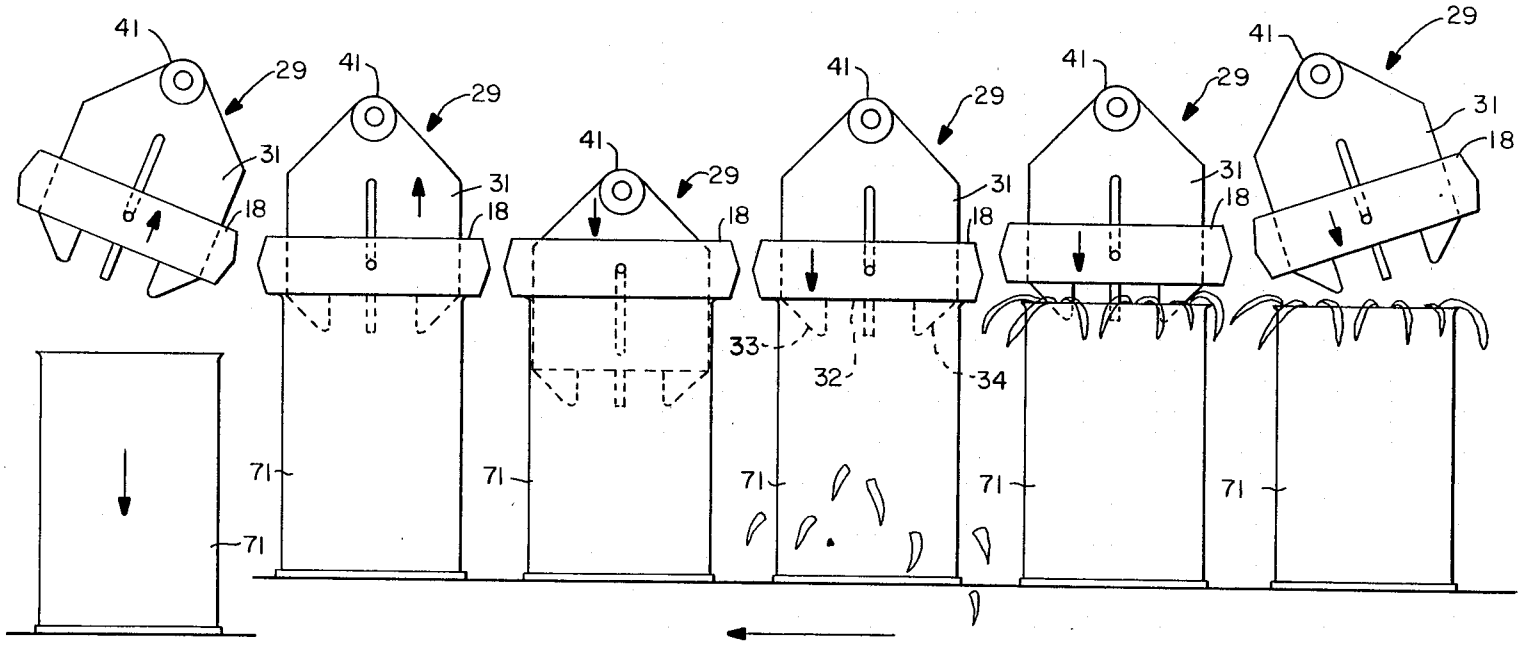

The method of operation of the machine can be best understood by reference to FIG. 5. The cans 71 enter at the position of FIG. 5A, and it is assumed that they have been filled with a predetermined amount of green beans. A number of the beans have been shown hanging over the upper edge of the can in a random fashion. A flight assembly overlies the can, but the piston has not been aligned with the axis of the can. FIG. 5B shows a further position of the can which corresponds to a position immediately below the trackway pieces 61. In this position the axis of the piston is generally aligned with the axis of the can, and the guide lugs have been partially introduced into the can. FIG. 5C shows a further position in which the flight has been lowered and pressed against the upper edge of the can, thus crushing the portions of the beans which were hanging over the upper edge. This crushing action may sever many of such beans, but some may be left hanging by unsevered fiber. Several fragments of the beans are shown falling from the can. FIG. 5D shows a further position in which the piston has been urged downwardly into the can, thus compressing the contents, and also sweeping away and completing the severing of any beans or bean fragments which may have been left hanging from the upper edge of the can by unsevered fiber or which may be adhering to the inner peripheral surface of the can near the upper edge. FIG. 5E shows a further position in which the piston is in the process of being retracted from the can. In FIG. 5F the flight and piston assembly have been completely retracted from the can, and the can has been dropped to a lower elevation.

The machine and method is an improvement over devices and machines previously available for cleaning can flanges preparatory to seaming. Actual operation of the machine has been demonstrated to be effective in severing material like green beans which may remain hanging at random on the upper edge of the can, when a quantity of the beans is deposited in the can. In addition to the crushing and severing action of the flight when pressed against the upper edge of the can, which may be a force of the order of 100 lbs., the action of the plunger as it is advanced into the can effectively severs fiber and removes any remaining food from the can edge and from the inner periphery of the flange.

While the invention is particularly effective for the processing of whole or string beans, it is also deemed to be effective for other stringy food materials such as bean sprouts, bamboo shoots, sauerkraut and hand-packed spinach.

I claim:

1. A machine for cleaning the flanges of cans preparatory to can seaming after a food material like whole or french cut green beans has been introduced into open cans, comprising a first means for conveying the cans along a generally horizontal pathway with their open end portions uppermost, the cans containing a quantity of the food material with some of the food material disposed on the can flanges, a second conveying means disposed above the first conveying means, means carried by the second conveying means for applying pressure to the upper flanges of the cans and to sever food material thereon, said last named means comprising pistons carried by the second conveying means, each piston having a cylindrical surface dimensioned closely to fit within the upper portions of the cans, a piston being presented to the upper open end of each of the cans as it moves along the pathway, a lower end of the cylindrical surface of each piston forming a cutting edge, means disposed above the second conveyor for causing each such piston to be advanced downwardly toward and into the upper end portion of an associated can whereby food material on the can flange is severed and the food therein is compressed, and means for subsequently retracting the piston from the can.

2. A machine as in claim 1, in which the second conveying means consists of an endless chain type conveyor having rigid flights, each piston being slidably carried by a flight of the conveyor.

3. A machine as in claim 1, in which the means for advancing each piston, and the means for retracting each piston comprises cam means.

4. A machine as in claim 1, in which each piston has members depending from its lower face for aligning the axis of the piston with the axis of the can as the piston is advanced into the can.

5. A machine for cleaning the flanges of food containing cans preparatory to can seaming, comprising first conveying means for conveying a row of cans with their open ends uppermost along a linear pathway, the cans containing a quantity of food material like green beans, said means serving to deliver cleaned cans at one end of the pathway, a second endless chain conveyor having a lower run of the same extending above and parallel to said pathway, a guideway underlying the lower run of the second conveyor, said second endless conveyor having rigid flight members, the spacing between the can centers along the pathway corresponding to the spacing between the centers of the flights, a piston slidably carried by each of the flight members, each piston having a cylindrical surface dimensioned closely to fit within the upper flange end of a can and also having a lower pressing face, each flight member having an annular opening in which the piston member is slidably disposed for vertical movement in the direction of its axis, means for driving the first conveying means and the second endless conveyor whereby the pistons carried by the endless conveyor are successively presented to the upper open ends of the cans, means for urging the flight members downwardly against the guideway underlying the lower run of the second conveyor, means for advancing the pistons downwardly as they progress along the lower run of the second conveyor means, thereby projecting the pistons into the upper portions of the cans while the cans are moving along the pathway whereby the food therein is compressed and food removed from the flanges of the cans, and means for retracting the pistons from the cans as the cans approach said one end of the pathway.

6. A machine as in claim 5 in which there is an annular junction between said lower pressing face and the cylindrical surface of each piston which forms an annular cutting edge.

7. A machine as in claim 6, in which means extending from said lower pressing face of piston serves to align the piston with the underlying can as the piston is projected into the can.

8. A machine as in claim 7, in which the aligning means consists of a plurality of circumferentially spaced lugs extending from said lower pressing face of the piston, the lugs each having a face that is coincident with a truncated conical surface having an axis coincident with the axis of the piston.

9. A machine as in claim 5, in which the means for urging the flight members downwardly against the upper edges of the cans consists of shoes disposed above the lower run of the endless conveyor, and spring means for urging the shoes downwardly against the lower run of the conveyor.

10. A machine as in claim 5, in which the means for advancing the pistons into the upper ends of the cans and for retracting the same consists of cam means disposed above the lower run of the endless conveyor, said cam means having inclined cam surfaces adapted to engage and urge the pistons downwardly into the cans and then upwardly out of the cans.

* * * * *